US008601711B2

(12) United States Patent
Kim

(10) Patent No.: US 8,601,711 B2
(45) Date of Patent: Dec. 10, 2013

(54) RADIAL ROTARY DRYER

(76) Inventor: Young Kim, Seoul (KR)

( * ) Notice: Subject to any disclaimer, the term of this patent is extended or adjusted under 35 U.S.C. 154(b) by 522 days.

(21) Appl. No.: 13/002,432

(22) PCT Filed: Mar. 12, 2009

(86) PCT No.: PCT/KR2009/001240

§ 371 (c)(1),
(2), (4) Date: Jan. 3, 2011

(87) PCT Pub. No.: WO2010/002092

PCT Pub. Date: Jan. 7, 2010

(65) Prior Publication Data

US 2011/0099833 A1 May 5, 2011

(30) Foreign Application Priority Data

Jul. 4, 2008 (KR) ..... 10-2008-0064624

(51) Int. Cl.
*F26B 11/18* (2006.01)

(52) U.S. Cl.
USPC ..... 34/60; 34/136; 34/167; 34/172; 34/196; 359/630; 210/715; 166/302; 366/228

(58) Field of Classification Search
USPC ..... 34/60, 77, 80, 135, 136, 172, 167, 168, 34/196; 359/13, 630; 210/694, 712, 715; 166/285, 302; 366/137.1, 228, 233
See application file for complete search history.

(56) References Cited

U.S. PATENT DOCUMENTS 2,253,047 A * 8/1941 Purkett ..... 34/87
3,023,514 A * 3/1962 Gibson ..... 34/589
3,137,546 A * 6/1964 Lamb ..... 34/371
3,208,735 A * 9/1965 Wolff ..... 366/54
3,484,949 A * 12/1969 Aronoff ..... 34/635
3,583,889 A * 6/1971 Califano et al. ..... 156/516
3,605,859 A * 9/1971 Leghorn ..... 164/474

(Continued)

FOREIGN PATENT DOCUMENTS

EP 114939 A2 * 8/1984 ..... C13F 5/00
JP 60047665 A * 3/1985 ..... A23L 1/337

(Continued)

OTHER PUBLICATIONS

International Search Report of International Application No. PCT/KR2009/001240, dated Nov. 2, 2009.

*Primary Examiner* — Steve M Gravini
(74) *Attorney, Agent, or Firm* — Kile Park Reed & Houtteman PLLC

(57) ABSTRACT

A radial rotary dryer improves drying efficiency for sludge and other substances, prevents clogging phenomenon, and is realized in a simple structure. The radial rotary dryer includes spaces formed by inner and outer drums and partitioned by a plurality of radial plates. The substances, which have been introduced through a drum inlet together with hot blowing air, sequentially move throughout all spaces and are dried during drum rotation. The substances are discharged through an opposite side of the inner drum. A lift plate is attached at one surface of each radial plate to improve the drying efficiency. Hammers are attached to an opposite surface of the radial plate to free-fall according to the rotation of the drum, thereby crushing the substances. The radial rotary dryer is useful to dry sewage sludge, food waste, or other industrial substances with the best drying efficiency, the minimum installation space, and a crushing function.

2 Claims, 4 Drawing Sheets

(56) References Cited

U.S. PATENT DOCUMENTS

| | | | | | |
|---|---|---|---|---|---|
| 3,690,622 | A | * | 9/1972 | Brunner et al. | 366/52 |
| 3,713,633 | A | * | 1/1973 | Falk et al. | 432/109 |
| 3,737,149 | A | * | 6/1973 | Muntzer et al. | 366/2 |
| 3,950,861 | A | * | 4/1976 | Weimer et al. | 34/130 |
| 4,071,962 | A | * | 2/1978 | Saeman | 34/135 |
| 4,430,003 | A | * | 2/1984 | Beattie et al. | 366/137.1 |
| 4,455,762 | A | * | 6/1984 | Saeman | 34/170 |
| 4,458,428 | A | * | 7/1984 | Saeman | 34/506 |
| 4,477,984 | A | | 10/1984 | Wenger | |
| 4,802,288 | A | | 2/1989 | Shinn | |
| 4,882,851 | A | * | 11/1989 | Wennerstrum et al. | 34/60 |
| 5,157,849 | A | * | 10/1992 | Ronning | 34/135 |
| 5,628,126 | A | * | 5/1997 | North | 34/599 |
| 5,638,606 | A | * | 6/1997 | Bryan et al. | 34/59 |
| 2011/0099833 | A1 | * | 5/2011 | Kim | 34/128 |

FOREIGN PATENT DOCUMENTS

| | | | | | |
|---|---|---|---|---|---|
| JP | 05-039981 | A | | 2/1993 | |
| JP | 09310978 | A | * | 12/1997 | F26B 17/32 |
| KR | 20-0200733 | Y1 | | 10/2000 | |
| KR | 1020010035512 | A | | 5/2001 | |
| WO | WO 2008072889 | A1 | * | 6/2008 | D06F 58/04 |
| WO | WO 2010002092 | A1 | * | 1/2010 | |

* cited by examiner

RADIAL ROTARY DRYER

TECHNICAL FIELD

The present invention relates to a multi-purpose radial rotary dryer capable of drying sewage sludge or food waste.

BACKGROUND ART

A single rotary dryer (Kiln) or a three-pass rotary dryer is an industrial drier used for multiple purposes to dry sludge or food waste. In general, sludge has the percentage of water content approximating 80%. After passing through a dryer, the sludge has the drying performance of less than 10%.

The three-pass rotary dryer represents superior drying efficiency 1.5 times greater than that of the single rotary dryer. The three-pass rotary dryer had been registered as a patent in U.S. for the first time in 1984 (see cited reference 1). In U.S., several companies (Vincent Co. and Stela Co.) have developed and used the three-pass rotary dryer in order to dry various foods or coffees. Recently, as environmental pollution has been issued, the three-pass rotary dryer has been used for drying swage sludge (e.g., ANDRITZ Co. of Austria). However, since the drying efficiency and the circulation rate are lowered in the $2^{nd}$ or $3^{rd}$ drum of the dryer, it is not easy to obtain the dried substance with the proper percentage of water content. In addition, since the internal circulation space for the sludge is relatively narrow, the sludge may be massed, so that the rotary dryer may be clogged. If the amount of the food waste or the size of a target to be dried is great, the existing three-pass rotary dryer cannot be used. In order to reduce the clogging phenomenon, the external diameter of the drum must be increased. However, a three-pass rotary dryer having a large diameter requires a wider installation area, represents energy inefficiency, and is dangerous in operation thereof.

Cited Reference 1: U.S. Pat. No. 4,477,984 (Oct. 23, 1984), Harvey Wenger

DISCLOSURE

Technical Problem

An object of the present invention is to provide a novel radial rotary dryer suggested to overcome disadvantages of a conventional three-pass rotary dryer. Hot blowing air and substances introduced into an inner drum sequentially move throughout spaces partitioned in a radial direction such that the substances are dried and discharged through the inner drum.

Since a radial circulation space has a sufficiently wide area, larger substances can be more easily dried, the drum can be prevented from being clogged. In addition, a great amount of substances can be continuously dried without excessively increasing the diameter or the length of equipment. In addition, during drying the substances, the substances are crushed, so that the drying efficiency can be more improved.

Technical Solution

In order to accomplish the object of the present invention, there is provided a radial rotary dryer used for multiple purposes in various industrial fields. The radial rotary dryer includes a drum 200 which includes an outer drum 201, an inner drum 202 provided inside the outer drum 201, a radial plate 203 radially interposed between the outer and inner drums 201 and 202, a lift plate 204 attached to one surface of the radial plate 203, a drum inlet-side plate 210 and a drum outlet-side plate 211 positioned at both ends of the outer drum 201. The outer drum 201, the inner drum 202, the radial plate 203, the drum inlet-side plate 210 and the drum outlet-side plate 211 form a plurality of radial dry spaces 208. The inner drum 202 includes a drum inlet 230 used to introduce substances into the inner drum 202, an input port 206 used to introduce the substances into one of the radial dry spaces 208, an output port 207 receiving the substances dried while passing through the radial dry spaces 208, a drum outlet 231 discharging the substances that has been dried, and separation plates 205 blocking the substances, which has been introduced through the drum inlet 230, from moving to the drum outlet 231.

The drum 200 further includes hammers 301 fixed onto an opposite surface of the radial plate 203 by using a swing shaft.

Advantageous Effects

As described above, according to the present invention, even if the larger volume of substances are dried by using a plurality of radial circulation spaces 208, the circulation spaces 208 are not clogged. When a great amount of substances are dried, the radial rotary drum having a smaller diameter and a shorter length as compared with those of the conventional rotary dryer are used, so that the small installation area and stable operating efficiency can be obtained. Accordingly, the stability in the equipment operation and drying efficiency can be improved, so that the radial rotary dryer according to the present invention is suitable for a multi-purpose industrial dryer.

BEST MODE

Mode for Invention

The present invention relates to a multi-purpose radial rotary dryer capable of drying sewage sludge or food waste. The radial rotary dryer is suitable for drying a substance having a volume greater than that of an existing three-pass rotary dryer.

Figure 1:
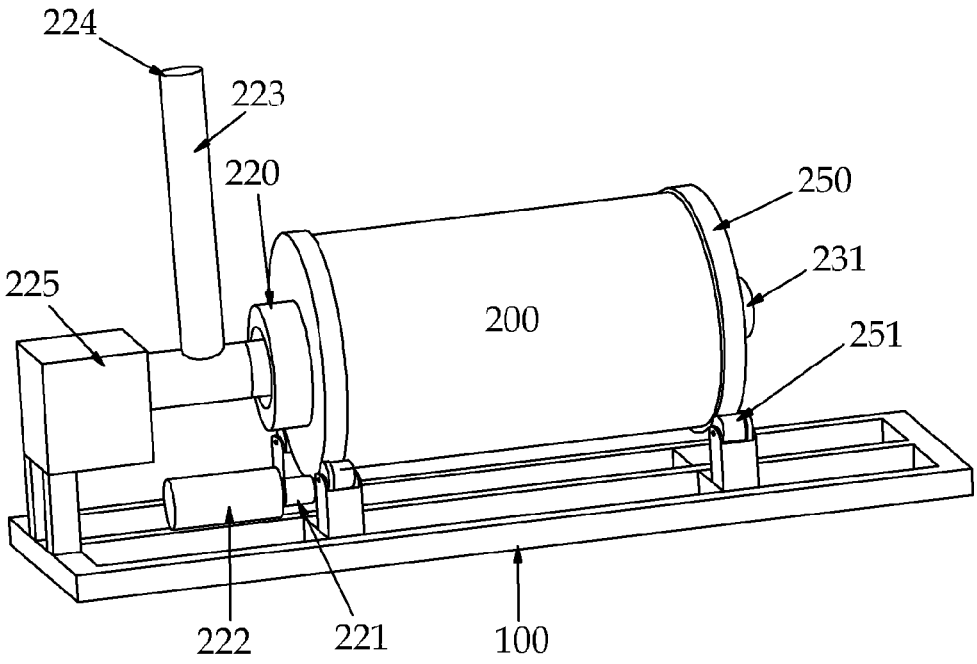
FIG. 1 is a perspective view showing a radial rotary dryer according to the present invention.

FIG. 1 is a perspective view showing the radial rotary dryer according to the present invention. The radial rotary dryer includes a radial drum 200, a frame 100, a burner 225 to supply hot blowing air to the radial drum 200, and a substance input unit 223 to supply a substance to be dried to the radial drum 200. The radial drum 200 is supported with respect to the frame 100 by using two drum bearings 250 and four roller bearings 251. After a substance, which has been input through a substance inlet 224, passes through the substance input unit 223, the substance is introduced into the radial drum 200 together with hot blowing air supplied from the burner 225.

Figure 2:
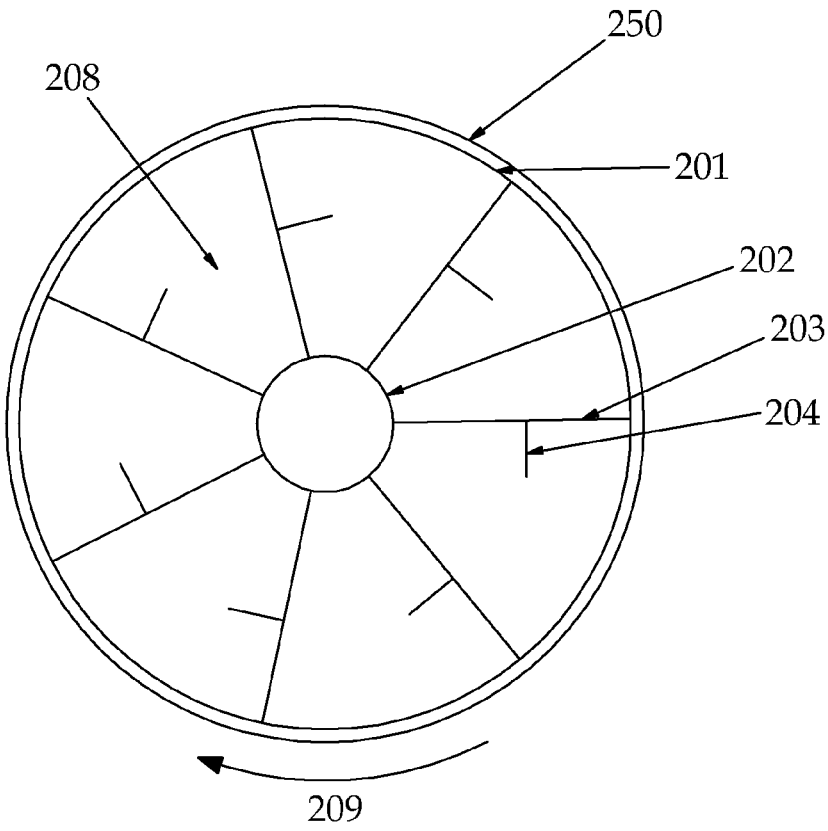
FIG. 2 is a sectional view showing a radial drum according to the present invention.
Figure 3:
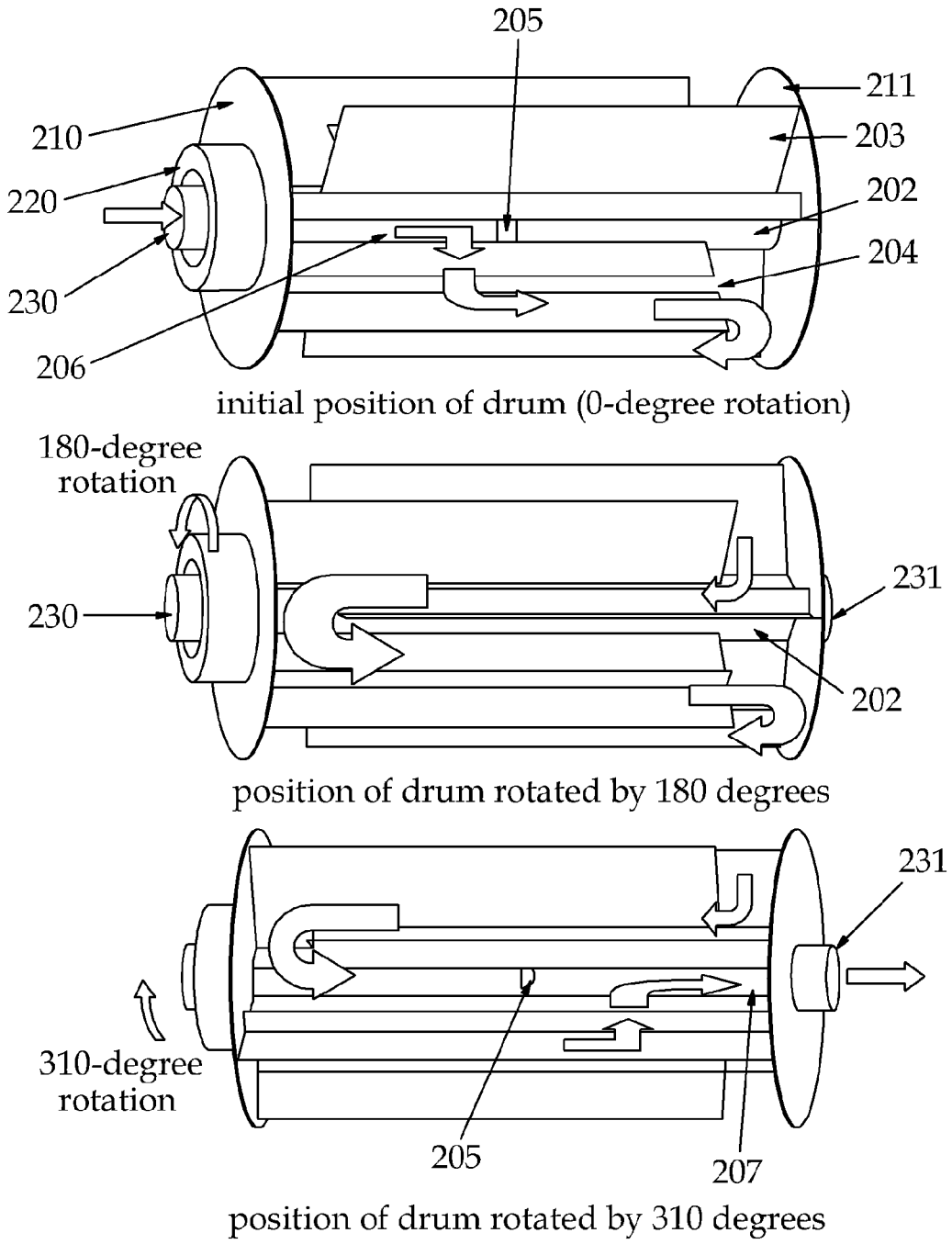
FIG. 3 shows views representing the drying principle of the radial drum according to the present invention.

FIG. 2 is an axial-direction sectional view showing the radial drum 200, and FIG. 3 shows the rotary drum 200 without an outer drum 201 for the purpose of explanation. Referring to FIGS. 1 to 3, the drum 200 includes the outer drum 201, an inner drum 202 provided inside the outer drum

201, a radial plate 203 radially interposed between the outer and inner drums 201 and 202, a lift plate 204 attached to one surface (surface opposite to a rotation direction 209) of the radial plate 203, a drum inlet-side plate 210 positioned at the side of an inlet of the outer drum 201, a drum outlet-side plate 211 positioned at the side of an outlet of the outer drum 201, and a driven-sprocket 220 for rotating the drum 200. The outer drum 201, the inner drum 202, the radial plate 203, the drum inlet-side plate 210, and the drum outlet-side plate 211 constitute a plurality of radial dry spaces 208.

The driven-sprocket 220 and the drum 200 rotate in an arrow direction by a driving motor 222 fixed to the frame 100 and a driving-sprocket 221 directly connected to the driving motor 222. As the drum 200 rotates, substances put into the drum 200 are mixed with each other by lift plates 204 in the radial dry spaces 208 partitioned by the radial plate 203 while being dried. In this case, the substances are dried while moving throughout the radial dry space 208 in a direction opposite to the rotational direction 209 of the drum 200.

FIG. 3 shows the positions of substances according to the rotation (rotation angle of 0, 180, or 360 degrees) of the rotary drum 200 in order to represent the drying principle of the radial drum 200 in more detail. The substances are introduced into the inner drum 202 together with the hot blowing air through a drum inlet 230.

As the rotary drum 200 rotates in an arrow direction (see 209 of FIG. 2) of FIG. 3, the substances move to the radial dry spaces 208 through an input port 206 of the inner drum 202. The substances are dried while being mixed with each other by the lift plate 204 in the radial dry spaces 208.

After about 30 minutes to about 40 minutes lapse from the input time point of the substances, the substances, which have been dried while passing through the radial dry spaces 208, are discharged through an output port 207 of the inner drum 202 and the output outlet 231. The lift plate 204 is inclined with respect to a rotational shaft such that the substances automatically move according to the rotation of the drum 200 and are discharged through the drum outlet 231. Separation plates 205 are attached at the central portion of the inner drum 202, thereby preventing the substances and the hot blowing air which have been introduced through the drum inlet 230 from being directly output through the drum outlet 231.

Figure 4:
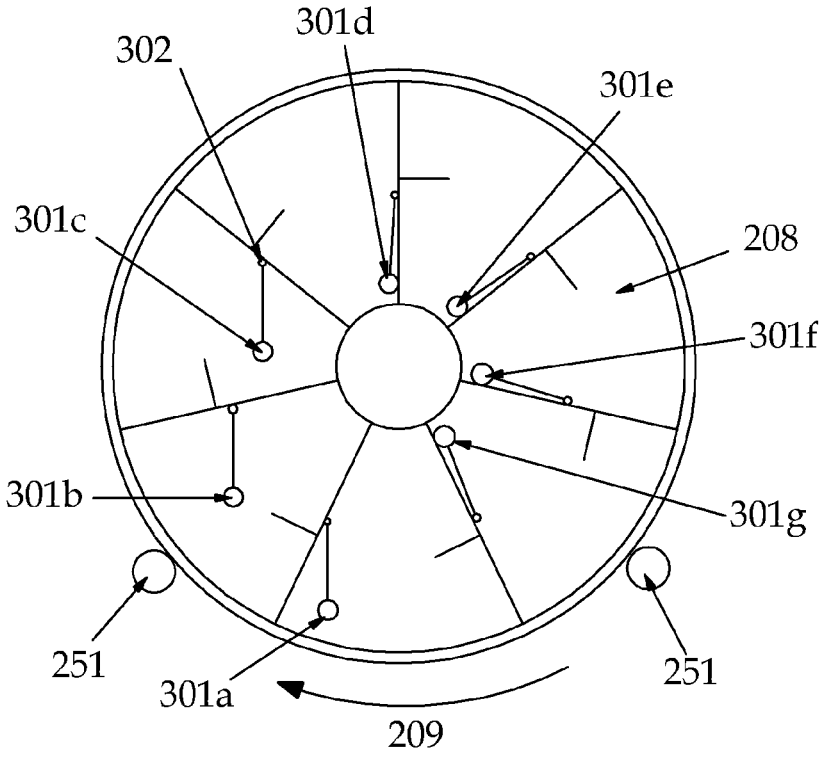
FIG. 4 is a sectional view showing the radial drum having a function of crushing a dry substance.

FIG. 4 shows another embodiment of the present invention. Referring to FIG. 4, hammers 301*a* to 301*g* extending in an axial direction are attached to a rear surface (i.e., rear surfaces of the attachment surfaces of radial plates 203) of the radial plates 203 inside the radial rotary drum 200 such that the substances are crushed by the hammers 301*a* to 301*g* free-fallen due to the rotation of the drum 200. Rotation center shafts of the hammers 301*a* to 301*g* are fixed on the radial plates 203. FIG. 4 shows the positions of the hammers 301*a* to 301*g* according to the rotational angles of the drum 200 over the fixed roller bearing 251. The hammer 301*g* free falls to the position of the hammer 301*a* according to the rotation of the drum 200 to apply impact to the substances, so that the substances are crushed.

The invention claimed is:

1. A radial rotary dryer used for multiple purposes in various industrial fields, the radial rotary dryer comprising:

a drum (200) which includes an outer drum (201), an inner drum (202) provided inside the outer drum (201), a radial plate (203) radially interposed between the outer and inner drums (201, 202), a lift plate (204) attached to one surface of the radial plate (203), a drum inlet-side plate (210) and a drum outlet-side plate (211) positioned at both ends of the outer drum (201), wherein the outer drum (201), the inner drum (202), the radial plate (203), the drum inlet-side plate (210) and the drum outlet-side plate (211) form a plurality of radial dry spaces (208), wherein the inner drum (202) includes a drum inlet (230) used to introduce substances into the inner drum (202), an input port (206) used to introduce the substances into one of the radial dry spaces (208), an output port (207) receiving the substances dried while passing through the radial dry spaces (208), a drum outlet (231) discharging the substances that has been dried, and separation plates (205) blocking the substances, which has been introduced through the drum inlet (230), from moving to the drum outlet (231).

2. The radial rotary dryer of claim 1, wherein the drum (200) further comprises hammers (301) fixed onto an opposite surface of the radial plate (203) by using a swing shaft.

* * * * *